US010635020B2

(12) United States Patent
Miyamoto

(10) Patent No.: US 10,635,020 B2
(45) Date of Patent: Apr. 28, 2020

(54) IMAGE FORMING APPARATUS

(71) Applicant: KYOCERA Document Solutions Inc., Osaka-shi, Osaka (JP)

(72) Inventor: Teruyuki Miyamoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/514,224

(22) Filed: Jul. 17, 2019

(65) Prior Publication Data

US 2020/0026217 A1 Jan. 23, 2020

(30) Foreign Application Priority Data

Jul. 18, 2018 (JP) ..... 2018-135281

(51) Int. Cl.
*G03G 15/08* (2006.01)
*G03G 21/16* (2006.01)

(52) U.S. Cl.
CPC ..... *G03G 15/0813* (2013.01); *G03G 15/0808* (2013.01); *G03G 21/1647* (2013.01); *G03G 2221/1657* (2013.01)

(58) Field of Classification Search
CPC ..... G03G 15/0813; G03G 15/0808; G03G 2221/1657
See application file for complete search history.

(56) References Cited

U.S. PATENT DOCUMENTS 9,335,708 B1 * 5/2016 Makita ..... G03G 15/757
2008/0138115 A1 * 6/2008 Chadani ..... G03G 21/1839 399/167
2015/0212466 A1 * 7/2015 Fukunaga ..... G03G 15/2064 399/122

FOREIGN PATENT DOCUMENTS

JP 2013140255 A 7/2013

* cited by examiner

*Primary Examiner* — G. M. A. Hyder
(74) *Attorney, Agent, or Firm* — Alleman Hall Creasman & Tuttle LLP

(57) ABSTRACT

An image forming apparatus includes a developing portion, a driving-side shaft coupling, a movement supporting mechanism, a movement member, a separating member, and a displacement member. The developing portion includes a developing roller that develops an electrostatic latent image formed on an image-carrying member, and a driven-side shaft coupling that is provided on the developing roller. The driving-side shaft coupling transmits driving force, via the driven-side shaft coupling, to the developing roller. The movement supporting mechanism movably supports the developing roller between a developing position and a separated position. The displacement member applies a force to the movement supporting mechanism, and positions the developing roller at the developing position. When the movement member moves further after the driven-side shaft coupling has separated from the driving-side shaft coupling, the displacement member moves the developing roller from the developing position to the separated position.

8 Claims, 12 Drawing Sheets

IMAGE FORMING APPARATUS

INCORPORATION BY REFERENCE

This application is based upon and claims the benefit of priority from the corresponding Japanese Patent Application No. 2018-135281 filed on Jul. 18, 2018, the entire contents of which are incorporated herein by reference.

BACKGROUND

The present disclosure relates to an image forming apparatus configured to transmit driving force to a developing roller via a shaft coupling.

Generally, in an image forming apparatus, a developing portion includes a developing roller that is disposed opposite an image-carrying member. A driving force is transmitted to the developing roller via a shaft coupling. In addition, the developing portion is configured to be removably attached to the image forming apparatus so that it can be replaced.

SUMMARY

An image forming apparatus according to an aspect of the present disclosure includes a developing portion, a driving-side shaft coupling, a movement supporting mechanism, a movement member, a separating member, and a displacement member. The developing portion includes a developing roller and a driven-side shaft coupling. The developing roller is configured to develop an electrostatic latent image formed on an image-carrying member. The driven-side shaft coupling is provided on the developing roller. The driving-side shaft coupling is configured to engage with the driven-side shaft coupling and transmit driving force, via the driven-side shaft coupling, to the developing roller. The movement supporting mechanism is configured to movably support the developing roller between a developing position and a separated position, wherein the developing position is where the developing roller develops the electrostatic latent image, and the separated position is further from the image-carrying member than the developing position. The movement member is configured to be movable in a predetermined movement direction. The separating member is configured to separate, in response to movement of the movement member, the driven-side shaft coupling from the driving-side shaft coupling. The displacement member is configured to, during separation of the driven-side shaft coupling from the driving-side shaft coupling, apply a force, to the movement supporting mechanism, in an approaching direction that extends from the separated position toward the developing position, and position the developing roller at the developing position. When the movement member moves further in the movement direction after the driven-side shaft coupling has separated from the driving-side shaft coupling, the displacement member applies a force, to the movement supporting mechanism, in a separating direction that extends from the developing position toward the separated position, and moves the developing roller from the developing position to the separated position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Figure 1:
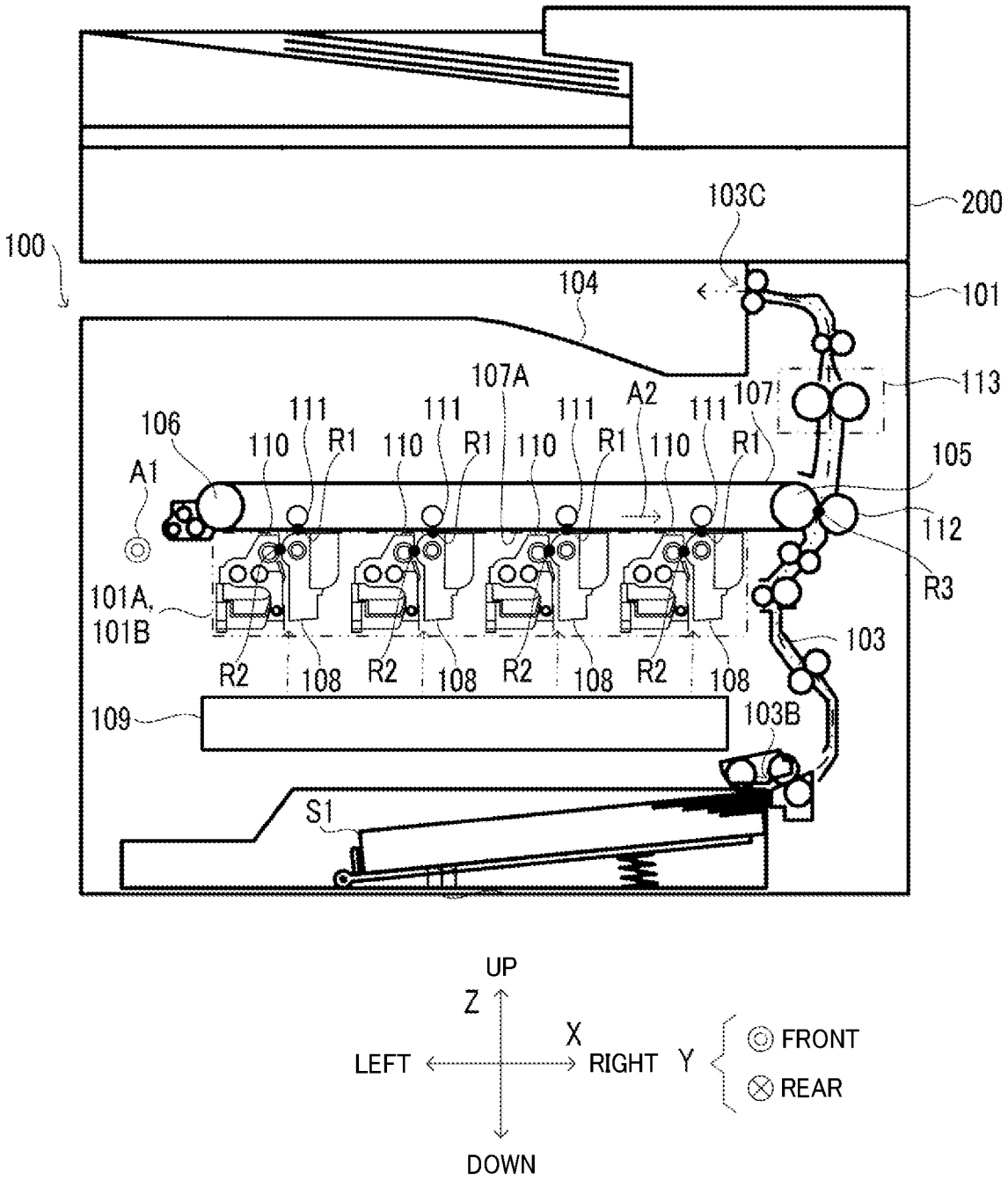
FIG. 1 is a diagram showing the inner configuration of an image forming apparatus, viewed from its front side, according to an embodiment.

In FIG. 1, an arrow X represents a first axis, an arrow Y represents a second axis, and an arrow Z represents a third axis. The first, second, and third axes are perpendicular to one another. Specifically, the first axis is a left-right axis of an image forming apparatus 100, the second axis is a front-rear axis of the image forming apparatus 100, and the third axis is an up-down axis of the image forming apparatus 100. Hereinafter, the first axis is referred to as a left-right axis X, the second axis is referred to as a front-rear axis Y, and the third axis is referred to as an up-down axis Z. It is noted that the first axis may be the front-rear axis Y, and the second axis may be the left-right axis X.

In addition, in the following, an XY plane is parallel to the left-right axis X and the front-rear axis Y. A YZ plane is parallel to the front-rear axis Y and the up-down axis Z. A ZX plane is parallel to the up-down axis Z and the left-right axis X.

In addition, in the following, length is a size along the front-rear axis Y, width is a size along the left-right axis X, and height is a size along the up-down axis Z.

In addition, as shown in FIG. 1, an arrow A1 represents a movement direction in which a movement member 11 (see FIG. 2) moves immediately before a developing portion 110 is removed from the image forming apparatus 100. Hereinafter, the movement direction is referred to as a movement direction A1. Specifically, the movement direction A1 is a direction extending from a rear side to a front side of the image forming apparatus 100.

FIG. 1 shows the image forming apparatus 100 that is a printer, a copier, or a multifunction peripheral. The multifunction peripheral includes a print function, a copy function, and a facsimile function.

The image forming apparatus 100 is controlled by a control portion (not shown) to perform a print process. Specifically, the image forming apparatus 100 generates printed matter by electrophotographically forming, based on image data, a full color or monochrome image on a sheet S1. Furthermore, the image forming apparatus 100 discharges the printed matter to a discharge portion 104. The image data is transmitted to the image forming apparatus 100 from an information processing apparatus (not shown) that is connected to the image forming apparatus 100, such that data communication is possible. The image data may be transmitted to the image forming apparatus 100 from an image reading portion 200 that is provided on top of the image forming apparatus 100.

The image forming apparatus 100 includes a housing 101. The image forming apparatus 100 further includes a conveyance path 103, the discharge portion 104, a driving roller 105, a driven roller 106, an intermediate transfer body 107, four process cartridge portions 108, an exposure portion 109, four developing portions 110, four primary transfer portions 111, a secondary transfer portion 112, and a fixing portion 113. The developing portions 110 and the primary transfer portions 111 are provided in correspondence with the process cartridge portions 108. It is noted that the number of process cartridge portions 108 is not limited to four. For example, in a case where the image forming apparatus 100 is configured to form only monochrome images, the number of process cartridge portions 108 may be one.

The housing 101 is an example of a housing according to the present disclosure. The housing 101 includes a frame and an exterior body. The housing 101 includes a storage space 101A, in which the process cartridge portions 108 and the developing portions 110 are removably attached.

As shown in FIG. 1, the storage space 101A, shown surrounded by a two-dot chain line, is provided inside the housing 101 at a position that is in the center of the left-right axis X and the up-down axis Z.

Figure 2:
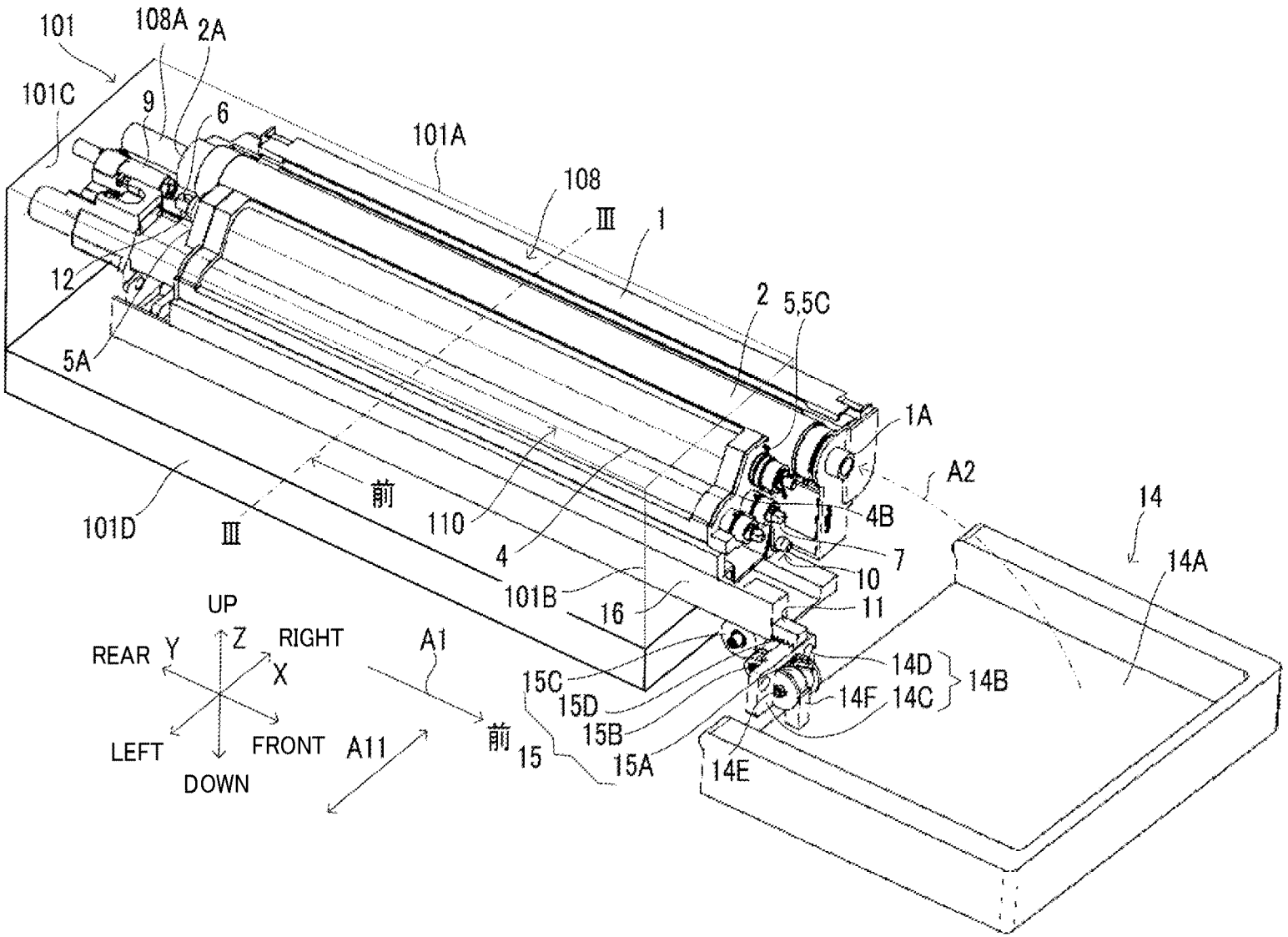
FIG. 2 is a perspective diagram showing main parts of the image forming apparatus shown in FIG. 1.

More specifically, as shown in FIG. 2, when an operation portion 14 is open, a front-end portion of the storage space 101A is an opening 101B that opens in the movement direction A1. The opening 101B is provided further downstream in the movement direction A1 than the four process cartridge portions 108 and the four developing portions 110. The opening 101B has an area that is sufficient for the four process cartridge portions 108 and the four developing portions 110 to be juxtaposed therein along the left-right axis X (see FIG. 1). It is noted that the operation portion 14 is a cover on the opening 101B that can be opened and closed by a worker. In addition, a rear end portion of the storage space 101A is partitioned off by a rear side frame 101C of the housing 101. The rear side frame 101C is separated from the opening 101B toward the rear side, such that the process cartridge portions 108 and the developing portions 110 can be stored on the inner side of the rear side frame 101C. A bottom side frame 101D of the housing 101 is provided on a bottom side of the storage space 101A.

As shown in FIG. 1 by a two-dot chain line, the conveyance path 103 extends substantially upward from an entrance 103B to an exit 103C. The exit 103C opens leftward at a portion on an upper-right side of the housing 101. The sheet S1 is conveyed through the conveyance path 103 from the entrance 103B to the exit 103C by a plurality of roller pairs.

A secondary transfer region R3 is predetermined inside the conveyance path 103. Specifically, the secondary transfer region R3 is a linear region, extending along the front-rear axis Y, in the conveyance path 103 where the intermediate transfer body 107 and the secondary transfer portion 112 face one another.

The intermediate transfer body 107 is an endless belt or the like. The intermediate transfer body 107 is disposed directly above the storage space 101A. The intermediate transfer body 107 is stretched across the driving roller 105 and the driven roller 106 that are separated from one another along the left-right axis X. When the driving roller 105 rotates, a specified portion 107A of the intermediate transfer body 107 travels in a traveling direction A2. The specified portion 107A is a portion on the outer surface of the intermediate transfer body 107, between the lower ends of the driven roller 106 and the driving roller 105. The traveling direction A2 is a direction extending from the lower end of the driven roller 106 to the lower end of the driving roller 105.

The four process cartridge portions 108 are juxtaposed along the left-right axis X and disposed directly below the specified portion 107A. In addition, each process cartridge portion 108 is elongated along the front-rear axis Y. The process cartridge portions 108 are stored inside the storage space 101A and are removably attached to the image forming apparatus 100.

Figure 3:
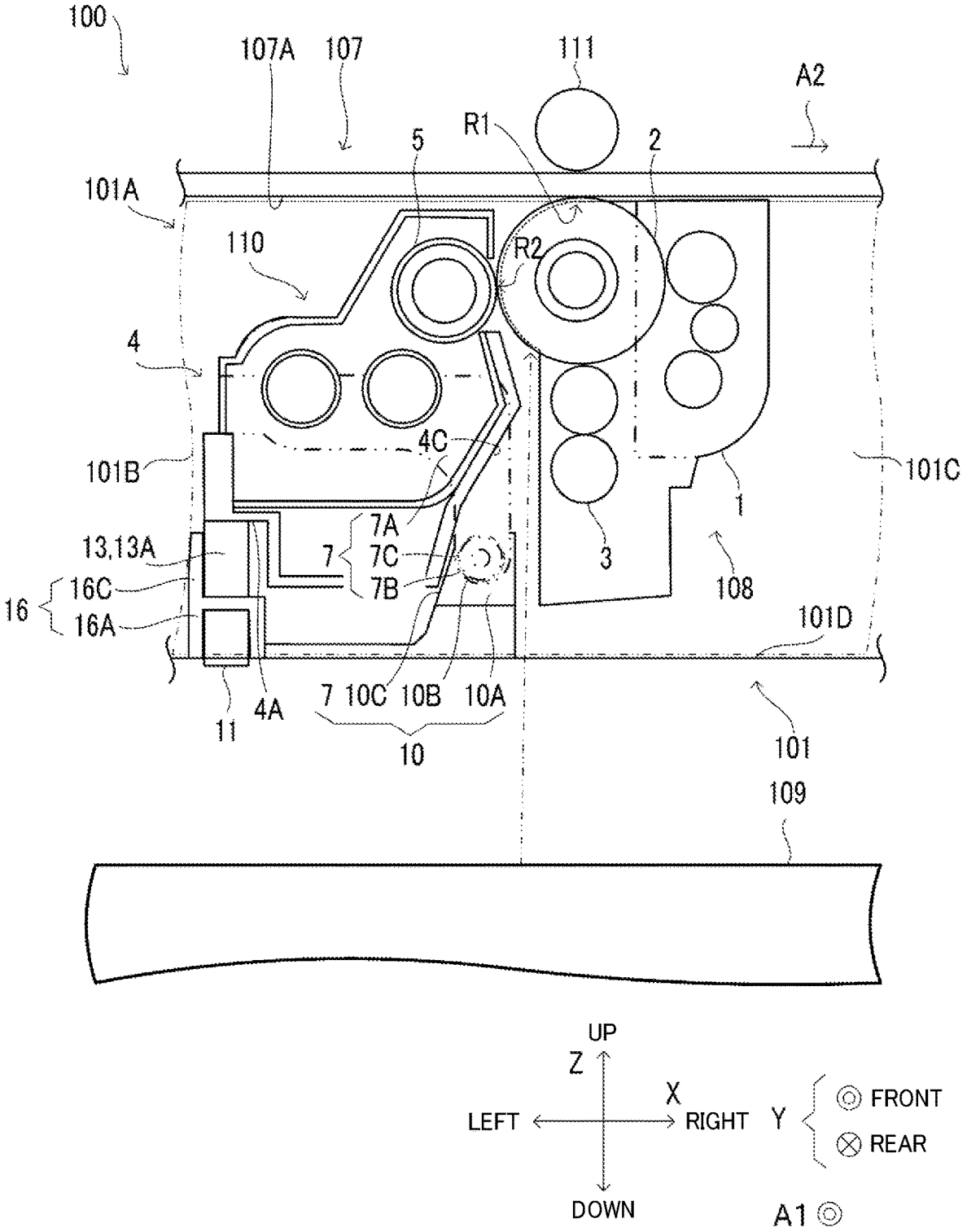
FIG. 3 is a diagram showing a front-side view of a cross-section, along the dot chain line III-III, of a process cartridge portion and developing portion shown in FIG. 2.

The four process cartridge portions 108 are provided corresponding to four predetermined colors, more specifically, yellow, cyan, magenta, and black. As shown in FIG. 3, each process cartridge portion 108 includes a housing 1, an image-carrying member 2, and a charging portion 3.

The housing 1 is provided in the storage space 101A and is elongated along the front-rear axis Y. The image-carrying member 2 and the charging portion 3 are stored inside the housing 1.

The image-carrying member 2 is a photoconductor drum or the like. The image-carrying member 2 is provided inside the housing 1 such that its upper end portion is positioned next to a primary transfer region R1 of its corresponding color. The primary transfer region R1 is a linear region that is elongated along the front-rear axis Y. The primary transfer regions R1 of each color are separated from one another, within the specified portion 107A, along the left-right axis X (see FIG. 1).

FIG. 2 shows a rear end portion 2A of each image-carrying member 2 that is mechanically connected to a secondary driving force transmitting portion 108A that includes a shaft coupling. The image-carrying member 2 is supported by the housing 1 such that it can be rotated by a driving force transmitted from the secondary driving force transmitting portion 108A.

It is noted that when the opening 101B is closed off by the operation portion 14, a front-end portion 1A of each housing 1 is pushed by a back surface 14A of the operation portion 14 (see arrow A2). With this configuration, the positions, along the front-rear axis Y and between the secondary driving force transmitting portion 108A and operation portion 14, of the housing 1, the image-carrying member 2, and the charging portion 3 are determined.

As shown in FIG. 3, each image-carrying member 2 is charged by its corresponding charging portion 3. The exposure portion 109 irradiates light on each image-carrying member 2 to form an electrostatic latent image of the corresponding color thereon. Each developing portion 110 develops the electrostatic latent image using toner of the corresponding color. With this configuration, a toner image of the corresponding color is formed on each image-carrying member 2.

The developing portion 110 is stored inside the storage space 101A of the housing 101, and is removably attached to the image forming apparatus 100 so that it can be replaced.

Figure 5:
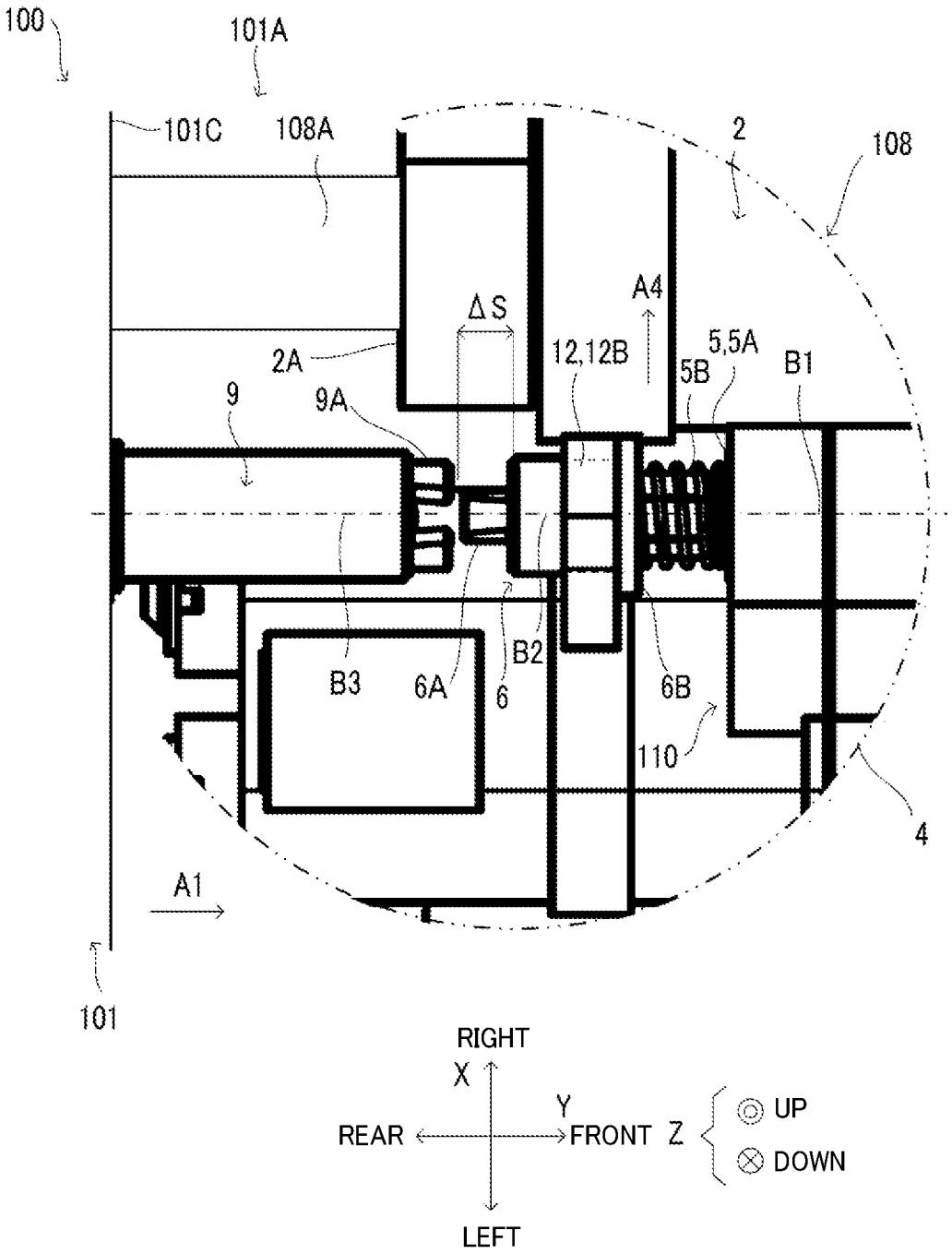
FIG. 5 is a diagram of a driven-side shaft coupling and driving-side shaft coupling shown in FIG. 2, when viewed from above.

As shown in FIG. 2, each developing portion 110 includes a housing 4, a developing roller 5, a driven-side shaft coupling 6, and a projecting portion 6B (see FIG. 5).

as shown in FIG. 2, the housing 4 is elongated along the front-rear axis Y. As shown in FIG. 3, the housing 4 is disposed on the left side of its corresponding process cartridge portion 108 inside the storage space 101A. A bottom portion 4A of the housing 4 is separated upward from the bottom side frame 101D. It is noted that when the developing portion 110 is attached to the image forming apparatus 100, a position determining portion (not shown) determines the position of the housing 4 so that it does not move in the movement direction A1.

Figure 4:
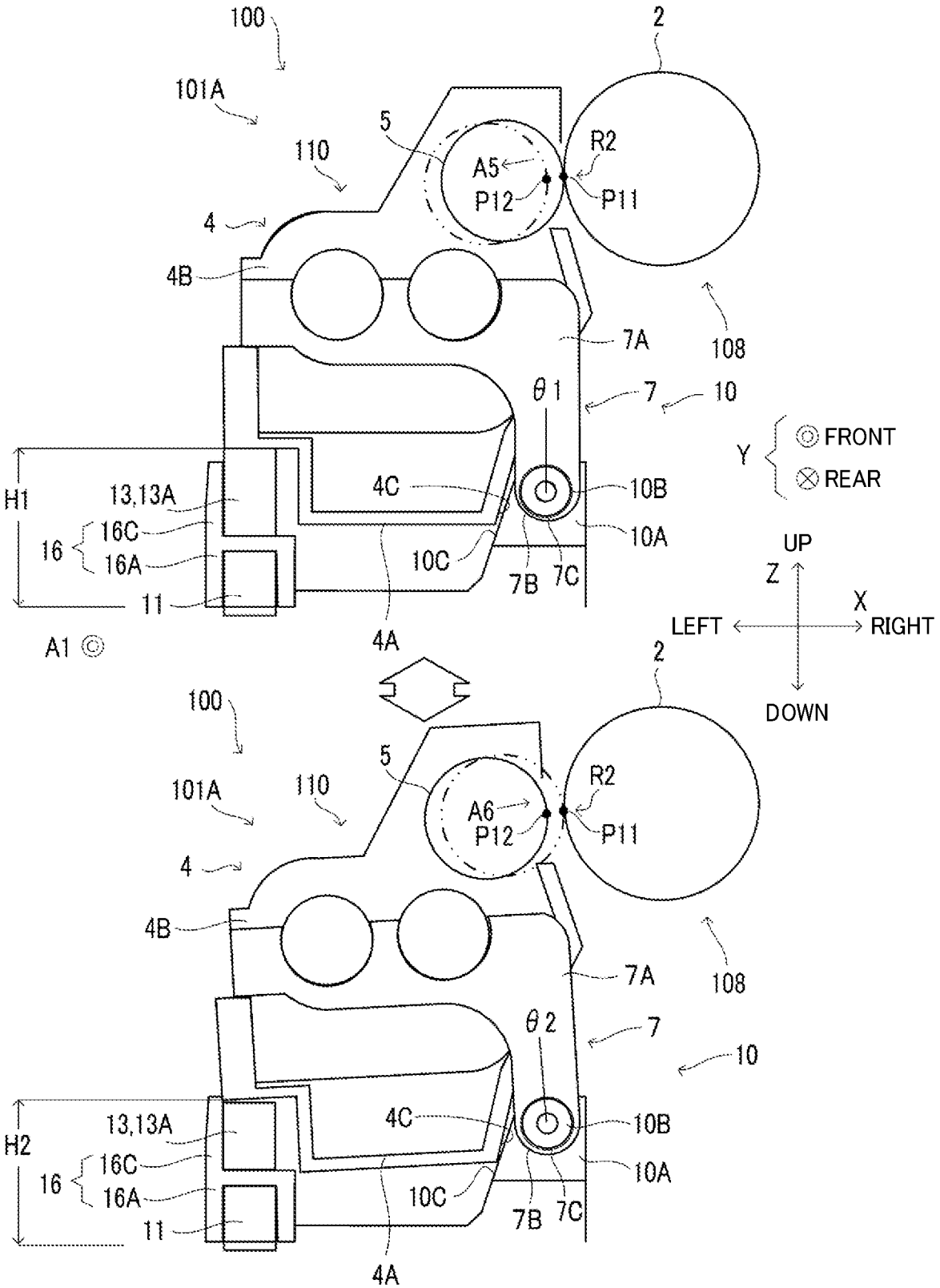
FIG. 4 is a diagram showing a front-side view of the developing roller, a link member, and a bottom portion of a housing shown in FIG. 2, and indicates the positions thereof in relation to one another.

The developing roller 5 is provided inside the housing 4 such that it is elongated along the front-rear axis Y. As shown in FIG. 4, the developing roller 5 is movable between a developing position P11 and a separated position P12. At the developing position P11, the developing roller 5 develops the electrostatic latent image that has been formed on the image-carrying member 2. The separated position P12 is an example of a separated position according to the present disclosure, and when positioned at the separated position P12, the developing roller 5 is separated further from the image-carrying member 2 than when the developing roller 5 is positioned at the developing position P11. Hereinafter, a direction extending from the developing position P11 to the separated position P12 is referred to as a separating direction A5. In addition, an opposite direction of the separating direction A5 is referred to as an approaching direction A6.

The developing roller 5 is supported by a movement supporting mechanism 10, described below, such that it moves with the housing 4. More specifically, the developing roller 5 is supported such that it rotates on the ZX plane about a supporting shaft 10B of the movement supporting mechanism 10. It is noted that the developing roller 5 may not be configured to move with the housing 4. That is, the developing roller 5 may move inside the housing 4. In addition, the developing roller 5 may move between the developing position P11 and the separated position P12 along the left-right axis X or the up-down axis Z.

When the operation portion 14 (see FIG. 2) is closed, the developing roller 5 is positioned at the developing position P11 by two displacement members 13. In this case, as shown in FIG. 4, the developing roller 5 at the developing position P11 is positioned opposite of a development region R2 of its corresponding image-carrying member 2, and is elongated along the front-rear axis Y. The development region R2 is a predetermined linear region elongated along the front-rear axis Y, and is positioned on a downstream side, in the rotation direction of the image-carrying member 2, of an exposure region. The exposure region is a linear region where light is irradiated on the image-carrying member 2.

It is noted that the developing roller 5 may be of a contacting type or an approaching type. In the case where the developing roller 5 is of the contacting type, when positioned at the developing position P11, the developing roller 5 comes in contact with the development region R2. On the other hand, in the case where the developing roller 5 is of the approaching type, known position determining rollers or the like are provided on portions respectively on a rear end portion 5A side and a front-end portion 5C side of the developing roller 5. When the developing roller 5 is positioned at the developing position P11, it is held away from the image-carrying member 2 by the rollers.

As shown in FIG. 2, the developing roller 5 is supported by the housing 4 such that it is rotatable about a rotational center axis B1 (see FIG. 5). The rear end portion 5A of the developing roller 5 is mechanically connected, via the driven-side shaft coupling 6 and a driving-side shaft coupling 9, to a third driving force transmitting portion (not shown) that is provided on the housing 101. The developing roller 5 rotates by receiving a driving force from the third driving force transmitting portion.

As shown in FIG. 3, the developing roller 5 supplies, to the development region R2, toner of its corresponding color that is stored in the housing 4, and develops the electrostatic latent image formed on the image-carrying member 2. This allows for the toner image of the corresponding color to be formed on the image-carrying member 2. The toner image is conveyed to its corresponding primary transfer region R1 by rotation of the image-carrying member 2.

As shown in FIG. 3, each primary transfer portion 111 is positioned separated from its corresponding primary transfer region R1 by a distance equivalent to the thickness of the intermediate transfer body 107, and is elongated along the front-rear axis Y. Each primary transfer portion 111 transfers, at the primary transfer region R1, the toner image from the image-carrying member 2 to the same area of the specified portion 107A. This allows for the full color image to be formed. The full color image is carried on the specified portion 107A and conveyed to the secondary transfer region R3 (see FIG. 1).

The secondary transfer portion 112 shown in FIG. 1 is a secondary transfer roller or the like. The secondary transfer portion 112 is positioned on the right side of the secondary transfer region R3, is elongated along the front-rear axis Y, and faces the intermediate transfer body 107. The secondary transfer portion 112 is rotatably supported by the housing 101.

At the secondary transfer region R3, the full color image held on the intermediate transfer body 107 is transferred, by the secondary transfer portion 112, to the sheet S1 being conveyed through the conveyance path 103. Then, the sheet S1 on which the full color image has been transferred is sent out from the secondary transfer region R3 toward the downstream side of the conveyance path 103, and is sent into the fixing portion 113.

The fixing portion 113 fixes the full color image onto the sheet S1, and sends the sheet S1 out toward the downstream side of the conveyance path 103 as printed matter.

The discharge portion 104 is a discharge tray or the like. The discharge portion 104 is provided on the upper surface of the housing 101 at a position on the lower left side of the exit 103C. The printed matter is conveyed through the conveyance path 103, discharged from the exit 103C to the discharge portion 104, and placed on the discharge portion 104.

Generally, to remove a developing portion from a housing, the worker must perform multiple steps that are unlocking engagement between a shaft coupling that is provided on a developing roller side and a shaft coupling that is provided on an image forming apparatus housing side, and then separating the developing roller from an image-carrying member. When the worker performs the series of multiple steps, the efficiency of the removal of the developing portion is reduced. Accordingly, it is ideal to simplify the multiple steps and improve the efficiency of the removal of the developing portion.

As a solution to this issue, according to the image forming apparatus 100, it is possible to simplify unlocking of the engaged state of the shaft couplings, and separation of the developing roller from the image-carrying member.

As shown in FIG. 2, the image forming apparatus 100 includes, in correspondence with each developing portion 110, the driving-side shaft coupling 9, the movement supporting mechanism 10, the movement member 11, a separating member 12, two of the displacement members 13 (see FIG. 6), four of the operation portions 14, and an actuator 15.

As shown in FIG. 5, the driven-side shaft coupling 6 is provided in the developing portion 110 on the rear end portion 5A of the developing roller 5, and is rotatable about a rotational center axis B2 of the driven-side shaft coupling 6. The rotational center axis B2 is shown in FIG. 5 as a dot chain line, and is coaxial with the rotational center axis B1 of the developing roller 5. The driven-side shaft coupling 6 projects in the opposite direction (that is, toward the rear side) of the movement direction A1 from the rear end portion 5A. An engagement portion 6A that is engageable with an engagement portion 9A of the driving-side shaft coupling 9 is provided on a rear end portion of the driven-side shaft coupling 6. In addition, the driven-side shaft coupling 6 is energized toward the rear side by an energizing member 5B that is provided between the driven-side shaft coupling 6 and the rear end portion 5A. The energizing member 5B is a spring or the like.

The driving-side shaft coupling 9 is provided on the rear side frame 101C of the housing 101 such that it is rotatable about a rotational center axis B3 of the driving-side shaft coupling 9. The rotational center axis B3 is shown in FIG. 5 as a dot chain line. The driving-side shaft coupling 9 is separated from the rear end portion 2A of the image-carrying member 2 in one direction along the left-right axis X and in the opposite direction of the movement direction A1. Specifically, in the storage space 101A, the driving-side shaft coupling 9 is separated, from the rear end portion 2A of the image-carrying member 2, toward the diagonal rear-left direction.

The driving-side shaft coupling 9 engages with the driven-side shaft coupling 6, and transmits driving force to the developing roller 5 via the driven-side shaft coupling 6. Specifically, the driving-side shaft coupling 9 includes, on a front-end portion of the driving-side shaft coupling 9, the engagement portion 9A that engages with the engagement portion 6A. While the developing roller 5 is positioned at the developing position P11 and the operation portion 14 is closed, the engagement portion 6A engages with the engagement portion 9A from the movement direction A1. During the process of opening the operation portion 14 (see FIG. 2), a force in the movement direction A1 is applied to the driven-side shaft coupling 6 by the separating member 12. During this time, the engagement portion 6A is displaced by a predetermined displacement amount ΔS, and is separated in the movement direction A1 from the engagement portion 9A of the driving-side shaft coupling 9. It is noted that FIG. 5 shows a state where the engagement portion 9A and the engagement portion 6A are not engaged with one another, and the engagement portion 6A is separated, in the movement direction A1, from the engagement portion 9A.

The driving-side shaft coupling 9 is rotated by a driving force generated by a motor (not shown) that is provided on its housing 101 side, and when the engagement portion 9A and the engagement portion 6A are engaged with one another, the driving-side shaft coupling 9 transmits, via the driven-side shaft coupling 6, the driving force to the developing roller 5. Hereinafter, the state where the engagement portion 9A and the engagement portion 6A are engaged with one another and the driving force can be transmitted to the developing roller 5 is referred to as a "shaft coupling engaged state".

The projecting portion 6B is provided integrally with the driven-side shaft coupling 6 in the developing portion 110. The projecting portion 6B projects from the outer peripheral surface of the driven-side shaft coupling 6 in a centrifugal direction A4 that extends away from the rotational center axis B2 of the driven-side shaft coupling 6. Specifically, the projecting portion 6B is a flange portion projecting from the outer peripheral surface at a predetermined length, and has a plate-like shape whose thickness along the front-rear axis Y is small. It is noted that for convenience, FIG. 5 only shows one specific direction (right direction) of the centrifugal direction A4.

As shown in FIG. 4, the movement supporting mechanism 10 supports the developing roller 5 such that it can move between the developing position P11 and the separated position P12. The movement supporting mechanism 10 includes a link member 7, a front-end surface 10A, the supporting shaft 10B, a side surface 10C, a rear-end surface 10D (see FIG. 6), and a supporting shaft 10E (see FIG. 6).

As shown in FIG. 2, the link member 7 is provided on a front-end surface 4B that is included in the housing 4 of the developing portion 110, and is a plate-like member whose thickness along the front-rear axis Y is small. As shown in FIG. 4, the link member 7 includes a base end portion 7A and a tip end portion 7B. The base end portion 7A is fixed to the tip end portion 7B. The base end portion 7A extends toward the supporting shaft 10B from a portion on the bottom right corner of the front-end surface 4B of the housing 4 that is included in the developing portion 110. A through hole 7C, in which the supporting shaft 10B is inserted, is provided on the tip end portion 7B. The through hole 7C is an example of a through hole according to the present disclosure. The through hole 7C has a circular shape when viewed from the front of the image forming apparatus 100 in plane view (hereinafter referred to as front view). It is noted that the link member 7 is not limited to being provided on the front-end surface 4B of the housing 4, and may be provided on any portion near the front-end surface 4B of the housing 4.

Figure 6:
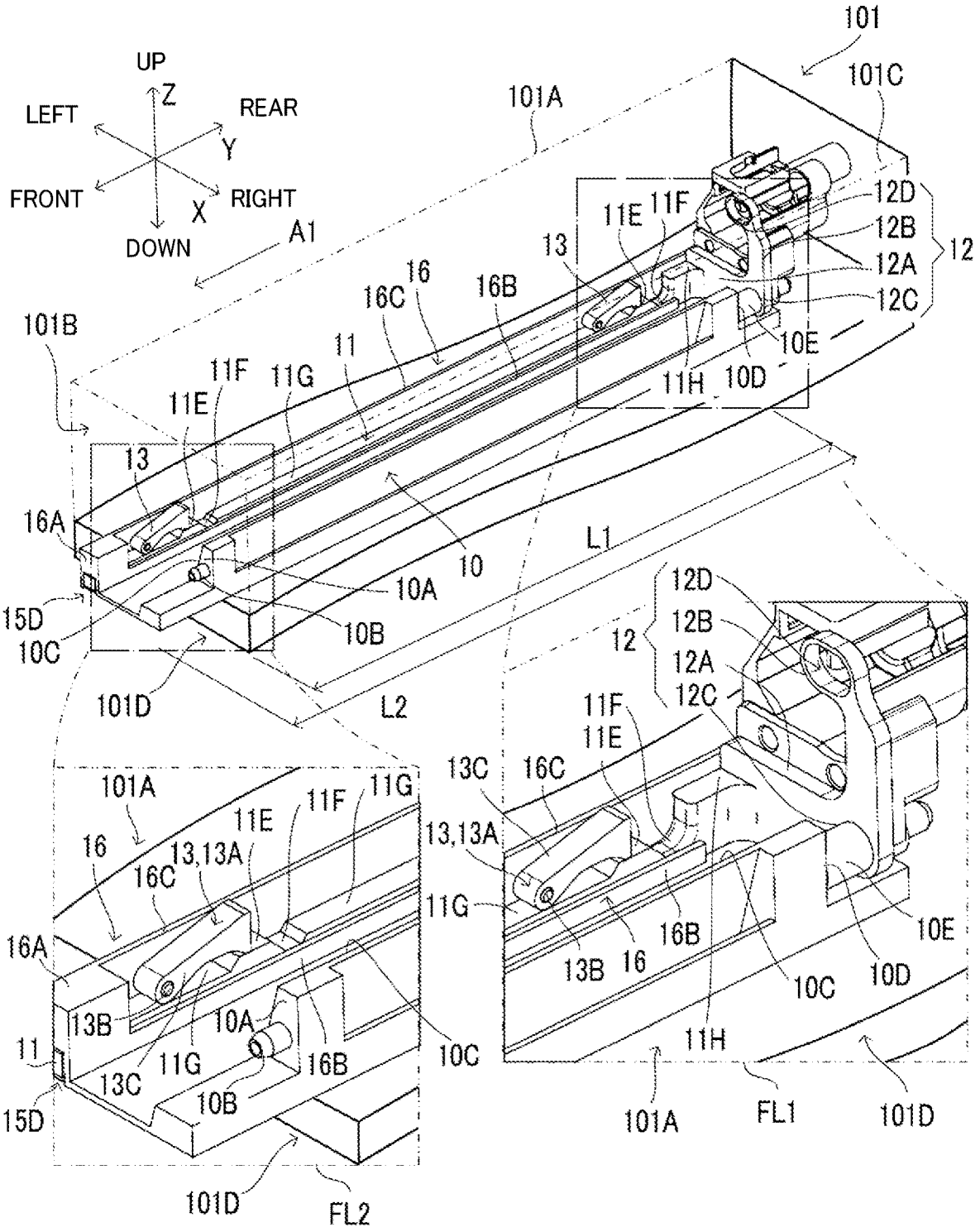
FIG. 6 is a perspective diagram showing a detailed configuration of a movement member, movement supporting mechanism, and displacement member shown in FIG. 4, when viewed from the diagonal front-right side.

As shown in FIG. 6, the front-end surface 10A, the supporting shaft 10B, the side surface 10C, the rear-end surface 10D, and the supporting shaft 10E are provided on the bottom side frame 101D. In addition, as shown in FIG. 3, the front-end surface 10A, the supporting shaft 10B, and the side surface 10C are provided in the space between the process cartridge portion 108 and the developing portion 110. Similarly, the rear-end surface 10D and the supporting shaft 10E are provided in the space between the process cartridge portion 108 and the developing portion 110. Specifically, the supporting shaft 10B, the side surface 10C, the rear-end surface 10D, and the supporting shaft 10E are provided between the bottom left portion of the process cartridge portion 108, and the bottom right portion of the developing portion 110.

As shown in FIG. 6, the front-end surface 10A is a trapezoidal surface that is parallel to the ZX plane. The front-end surface 10A extends upward from the same position along the front-rear axis Y as that of the front-end portion of the bottom side frame 101D. The front-end surface 10A has a predetermined height from the bottom side frame 101D. In addition, the front-end surface 10A is provided further toward the rear along the front-rear axis Y than the link member 7 (see FIG. 4).

The supporting shaft 10B is an example of a supporting shaft according to the present disclosure. As shown in FIG. 4, the supporting shaft 10B is provided at a position that is separated from the developing roller 5. Specifically, the supporting shaft 10B is provided at a position that is separated downward from the developing roller 5. However, the position of the developing roller 5 is not limited to this and may be provided at a position that is separated from the developing roller 5 in the upward direction or a direction along the left-right axis X.

Furthermore, the supporting shaft 10B is provided at a position that is separated from the displacement members 13. Specifically, the supporting shaft 10B is provided at a position that is separated rightward from the displacement members 13. However, the supporting shaft 10B is not limited to this position and may be provided at a position that is separated from the displacement members 13 in the leftward direction or a direction along the up-down axis Z.

More specifically, the supporting shaft 10B is provided at a position, between the displacement member 13 and its corresponding process cartridge portion 108, located toward the process cartridge portion 108.

The supporting shaft 10B projects forward from a position that corresponds to the through hole 7C in the front-end surface 10A. The supporting shaft 10B has a circular shape that is substantially the same as the through hole 7C from the front view. The supporting shaft 10B has a rotational center axis that is parallel to the rotational center axis B1 of the developing roller 5 (see FIG. 5). The supporting shaft 10B is inserted in the through hole 7C of the link member 7, and thus the link member 7 can be rotated about the supporting shaft 10B.

The link member 7, that is, the front portion of the developing portion 110, is supported by the supporting shaft 10B. such that it is rotatable along the ZX plane about the supporting shaft 10B. It is noted that the rear portion of the developing portion 110 (that is, the driven-side shaft coupling 6) is rotatably supported by the driving-side shaft coupling 9.

As shown in FIG. 6, the side surface 10C is a flat surface that extends rearward from the left side of the front-end surface 10A. The length of the side surface 10C, that is, a length L1 of the movement supporting mechanism 10, is substantially the same as that of the developing roller 5. The side surface 10C is sloped with respect to the YZ plane. Specifically, the higher the height of the side surface 10C is, the more it is sloped toward the process cartridge portions 108 (see FIG. 3). When the developing portion 110 is attached or removed from the developing portion 110, the side surface 10C comes in contact with the lower portion of a right-side portion 4C of the housing 4, and guides the developing portion 110 rearward or forward.

As shown in FIG. 6, the rear-end surface 10D is provided at a position separated rearward from the front-end surface 10A by a distance that is equivalent to the length L1. The rear-end surface 10D and the front-end surface 10A are parallel to one another. The supporting shaft 10E protrudes rearward from a position that corresponds to a through hole 12C in the rear-end surface 10D. The outer diameter of the supporting shaft 10E is the same as that of the through hole 12C. The supporting shaft 10E is inserted through the through hole 12C.

As shown in FIG. 6, the movement member 11 is provided on top of the bottom side frame 101D such that it is movable, in the predetermined movement direction A1, by a driving force applied thereto from the actuator 15. As shown in FIG. 3, the movement member 11 is provided at a position that is separated from the developing portion 110 and the movement supporting mechanism 10. Specifically, the movement member 11 is separated leftward from the movement supporting mechanism 10. In addition, as shown in FIG. 3, the movement member 11 is separated downward from the left-side portion of the bottom portion 4A of the developing portion 110. It is noted that the left-side portion of the bottom portion 4A, that is, the portion of the bottom portion 4A that is positioned above the movement member 11, is a flat surface that is parallel to the XY plane.

Figure 7:
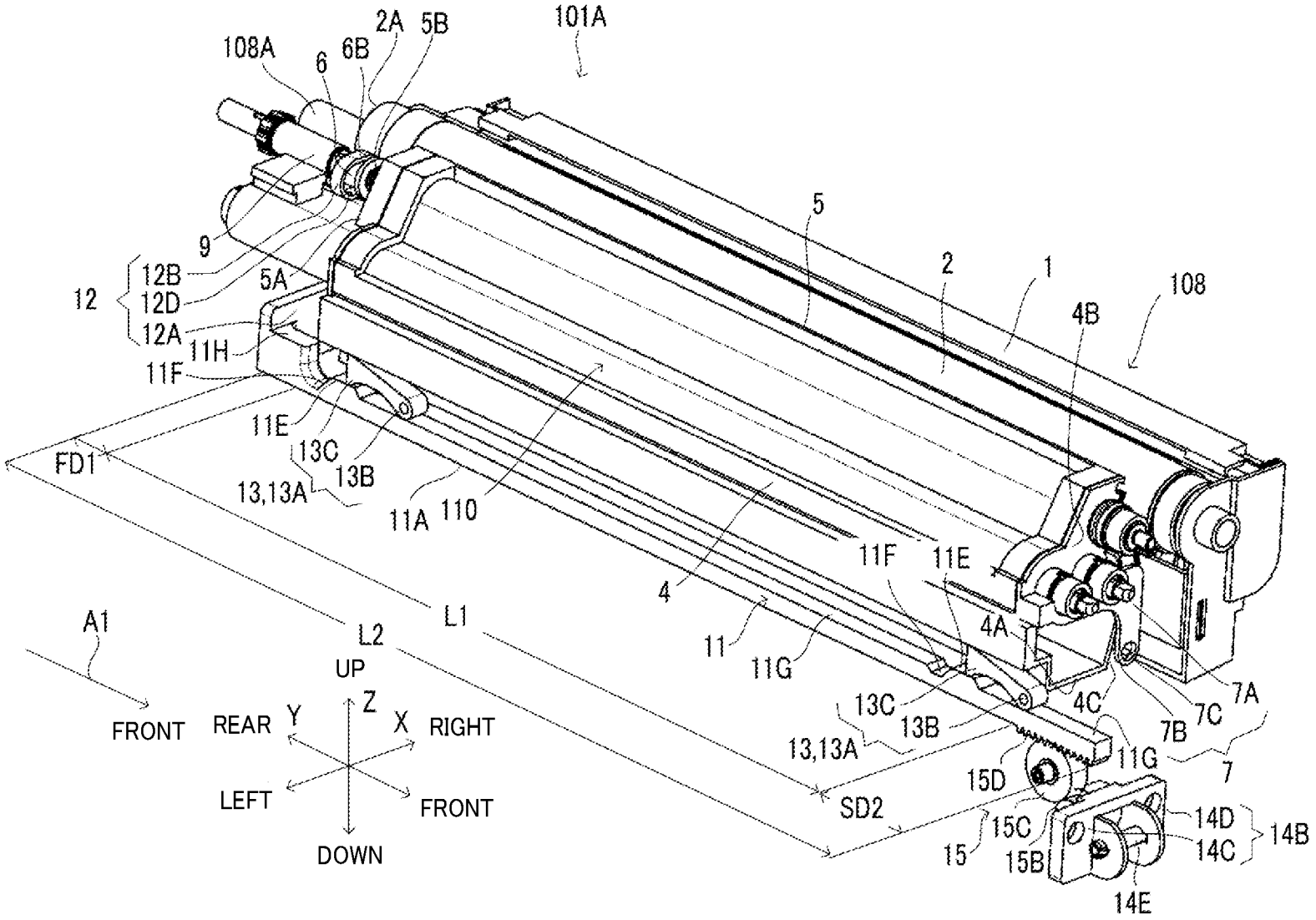
FIG. 7 is a perspective diagram showing a further detailed configuration of the movement member shown in FIG. 6, when viewed from its diagonal top-left side.

As shown in FIG. 7, the movement member 11 has a bar-like shape that is elongated along the front-rear axis Y. A length L2 of the movement member 11 is longer than the length L1 of the side surface 10C (see FIG. 6).

Figure 9A:
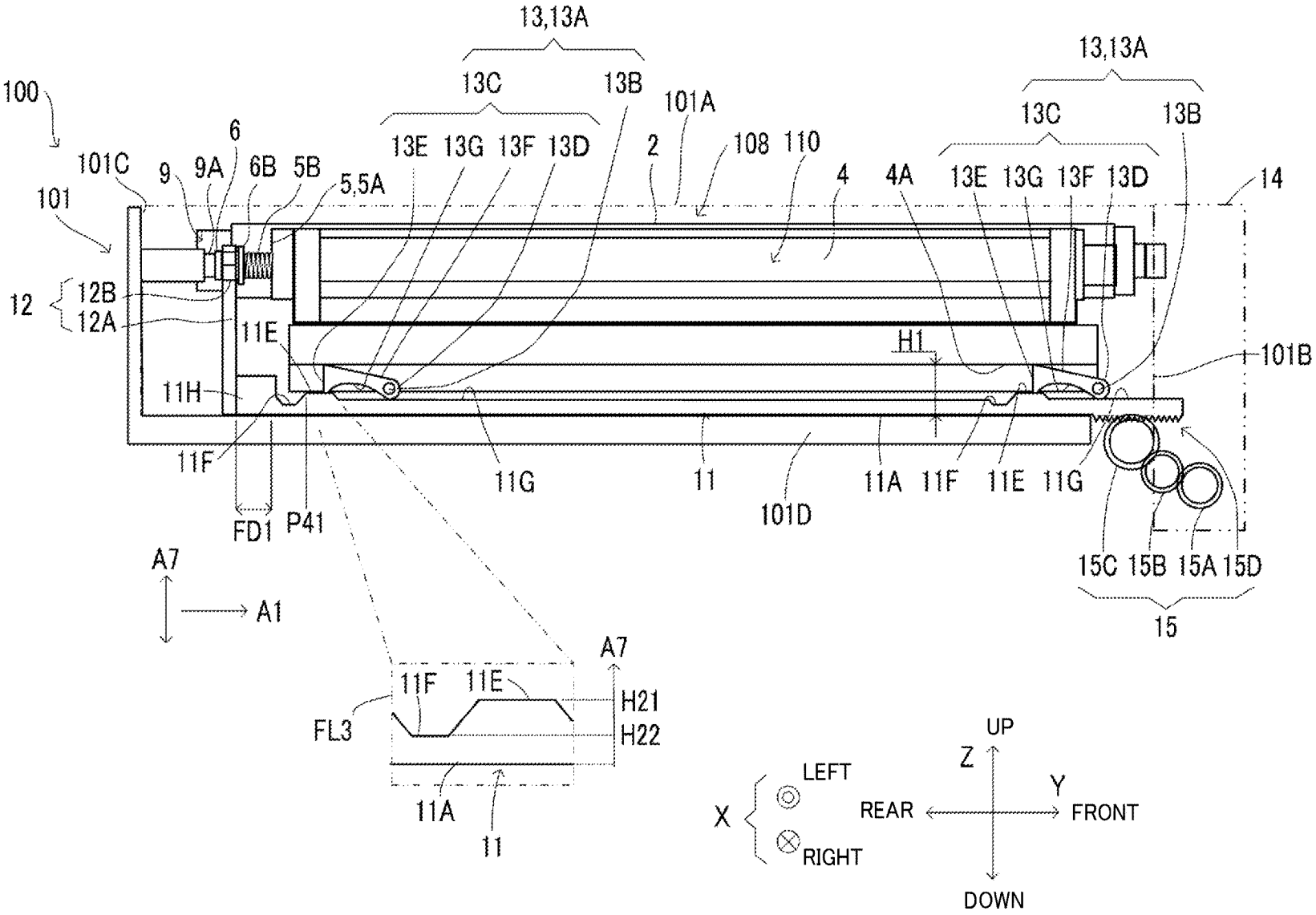
FIG. 9A is a diagram showing the states of the developing portion and cam member when a first surface shown in FIG. 7 is positioned at a movement start position P41.
Figure 9B:
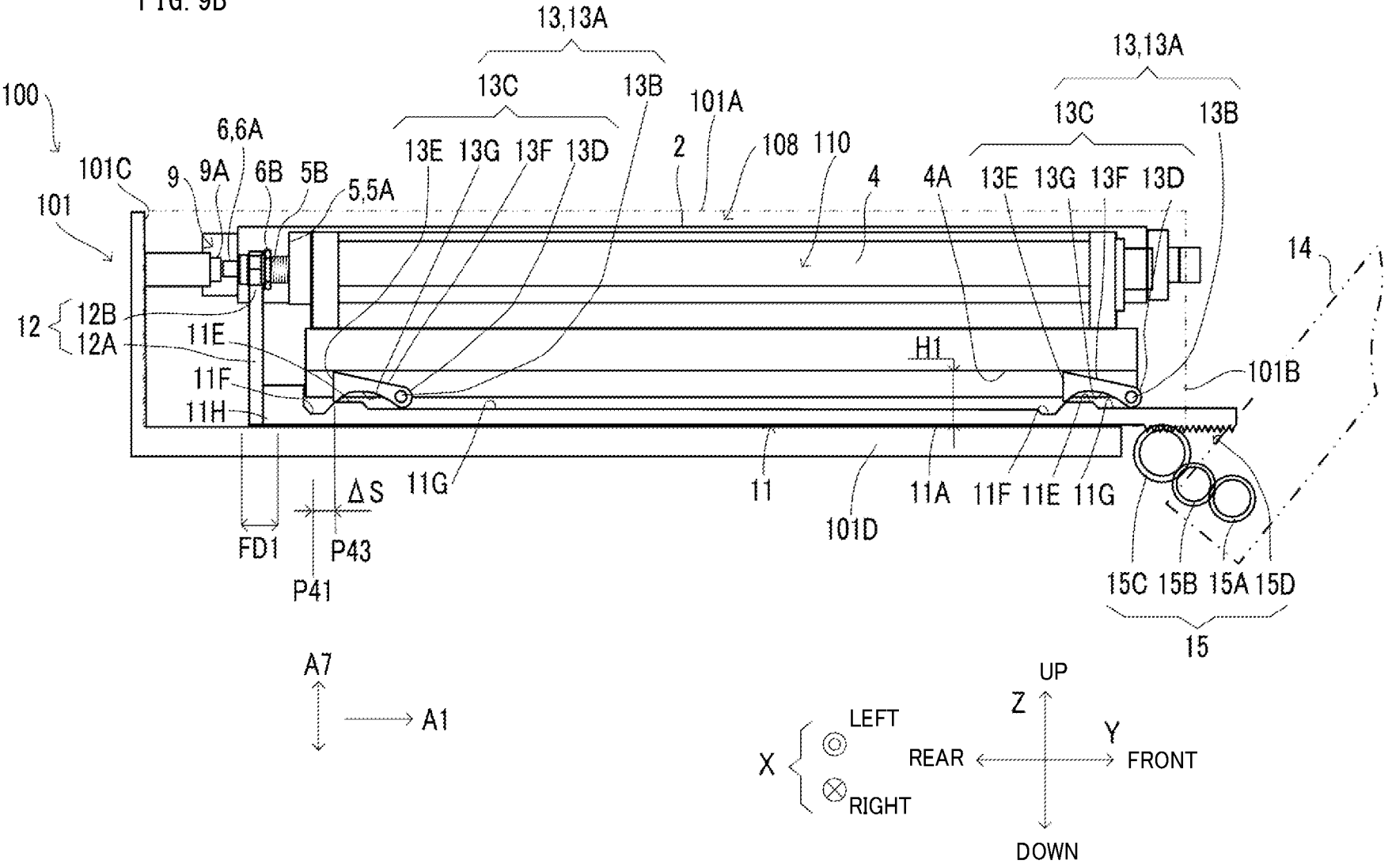
FIG. 9B is a diagram showing the states of the developing portion and cam member when the first surface shown in FIG. 7 is positioned at a specific position P43.
Figure 9C:
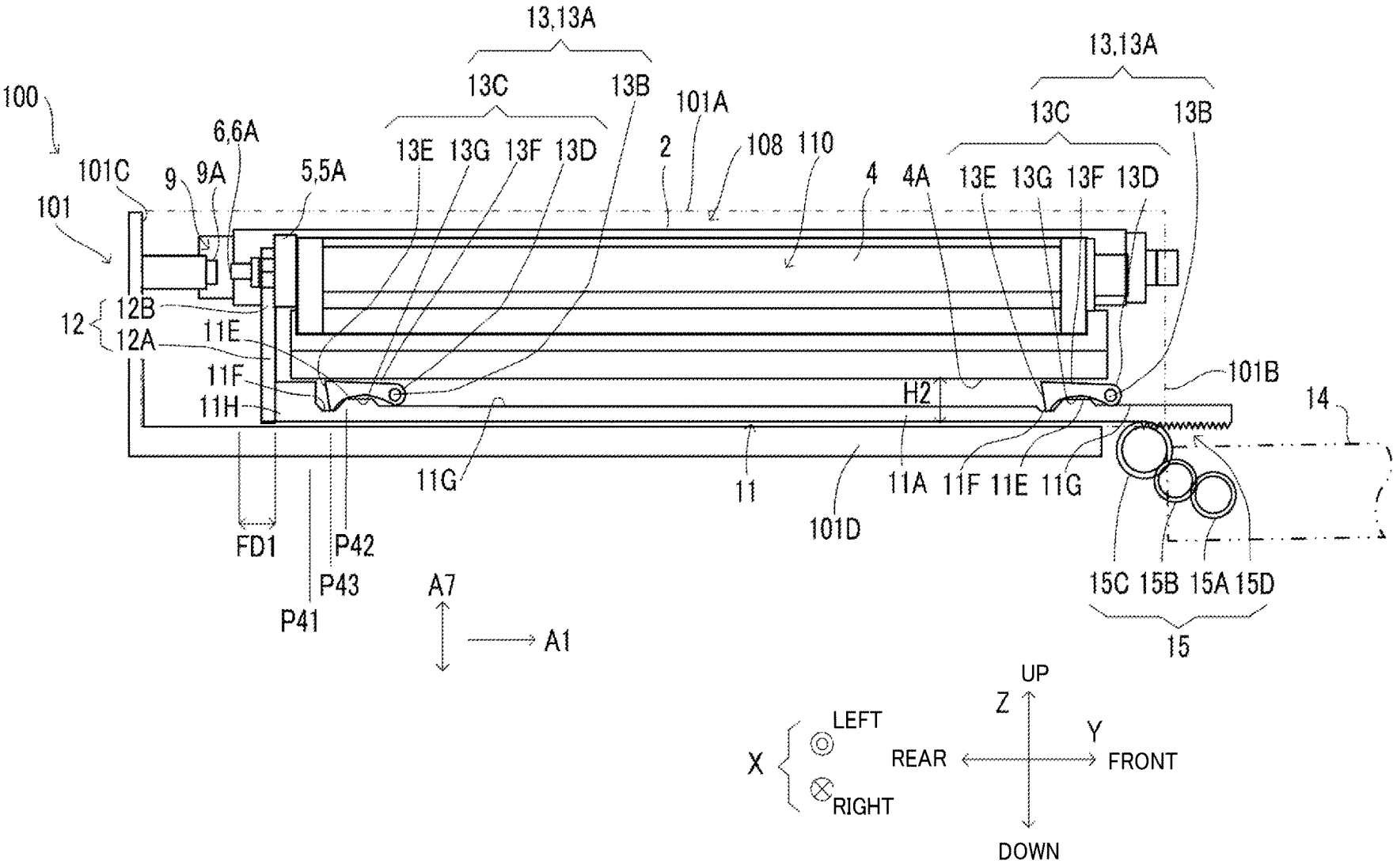
FIG. 9C is a diagram showing the states of the developing portion and cam member when the first surface shown in FIG. 7 is positioned at a movement end position P42.

As shown in FIG. 9A to FIG. 9C, the movement member 11 is movable, along the bottom side frame 101D, by a specific distance FD1 in the movement direction A1 (see FIG. 6). The specific distance FD1 is a distance that is longer than or equal to the displacement amount ΔS.

In addition, as shown in FIG. 7, a rack gear 15D is provided on the movement member 11.

The rack gear 15D is part of the configuration of the actuator 15, and is provided toward a front-end portion of the righthand surface 11A of the movement member 11. Specifically, the rack gear 15D is provided between the front-end portion of the righthand surface 11A and a portion of the righthand surface 11A that is separated rearward from the front-end portion by a specific distance SD2. It is noted that the specific distance SD2 is obtained by subtracting the length L1 and the length of the specific distance FD1 from the length L2. In addition, the rack gear 15D includes teeth that mesh with an output gear 15C that is included in the actuator 15. The righthand surface 11A, excluding the portion thereof on which the rack gear 15D is provided, is a surface that is parallel to the XY plane.

FIG. 7 shows first surfaces 11E, second surfaces 11F, and third surfaces 11G that are included in the upper surface of the movement member 11. Specifically, two sets of the first surface 11E, the second surface 11F, and the third surface 11G are provided on the upper surface of the movement member 11. The two sets of the first surface 11E, second surface 11F, and third surface 11G respectively correspond to two cam members 13A.

FIG. 9A to FIG. 9C show an intersecting axis A7 that is an axis that is perpendicular to the movement direction A1. Specifically, the intersecting axis A7 is the up-down axis. The first surface 11E and the second surface 11F of each set are located at different positions along the intersecting axis A7, and are juxtaposed along the movement direction A1.

Specifically, the first surfaces 11E have the same rectangular shape, and are surfaces that are parallel to the XY plane. The first surfaces 11E are provided at positions on the rear side of the rack gear 15D, and are separated from one another along the front-rear axis Y. The first surfaces 11E have the same height H21, as shown within frame FL3 in FIG. 9A, extending from the righthand surface 11A along the intersecting axis A7. The height H21 is predetermined in correspondence to the developing position P11 (see FIG. 4), a first angle position θ1 (see FIG. 4), and an approaching position P31 (see FIG. 8). When a lift portion 13C of each cam member 13A comes in contact with the first surface 11E, the developing roller 5 is positioned at the developing position P11.

The rear-end portion of the first surface 11E moves along the movement direction A1, by movement of the movement member 11, from a movement start position P41 (see FIG. 9A) to the movement end position P42 (see FIG. 9C). FIG. 9A shows the movement start position P41 that is a predetermined position of the rear-end portion of the first surface 11E in the shaft coupling engaged state. FIG. 9C shows the movement end position P42 that is a position separated, from the movement start position P41, in the movement direction A1 by the specific distance FD1.

In addition, as shown in FIG. 9B, during the movement of the movement member 11, the rear-end portion of the first surface 11E passes a specific position P43 that is located between the movement start position P41 and the movement end position P42. The specific position P43 is a position that is displaced, from the movement start position P41, in the movement direction A1 by the displacement amount ΔS. The specific position P43 is an example of a first specific position according to the present disclosure.

The second surface 11F has a height H22, different in size compared to the first surface 11E, extending from the righthand surface 11A along the intersecting axis A7. Specifically, the height H22 along the intersecting axis A7 is lower than the height H21. That is, the second surface 11F is provided at a lower position than the first surface 11E.

The second surfaces 11F are provided at positions that are separated from one another along the front-rear axis Y. Each second surface 11F is juxtaposed to the rear of its corresponding first surface 11E, and forms a recessed portion. It is noted that as long as each lift portion 13C can enter its corresponding recessed portion, it is not necessary for the second surfaces 11F to have the same shape. In addition, it is not necessary for the second surfaces 11F to be flat surfaces.

The third surface 11G is a surface that is parallel to the XY plane. The third surface 11G has a height extending from the righthand surface 11A that is higher than the height H22 and lower than the height H21. The third surfaces 11G are provided at positions that are separated from one another along the front-rear axis Y. Each third surface 11G is provided in front of its corresponding first surface 11E.

More specifically, as shown in FIG. 9A, the movement member 11 is provided on the bottom side frame 101D such that the rack gear 15D projects forward from the front-end portion of the bottom side frame 101D. The movement member 11 is restricted from moving along the up-down axis Z and the left-right axis X by a restricting member 16 (see FIG. 6) that is fixed to the bottom side frame 101D.

Specifically, the restricting member 16 includes a front-side restricting portion 16A, a right-side restricting portion 16B, and a left-side restricting portion 16C.

As shown in frame FL2 in FIG. 6, the front-side restricting portion 16A surrounds the front-end portion of the movement member 11 from above and from the left and right sides. This allows for the front-side restricting portion 16A to restrict movement of the front-end portion of the movement member 11 in the upward and left-right directions.

The right-side restricting portion 16B and the left-side restricting portion 16C are plate-like members that extend rearward from the front-side restricting portion 16A. The right-side restricting portion 16B projects upward from the bottom side frame 101D to a position that is lower than that of the third surface 11G of the movement member 11. The right-side restricting portion 16B comes in contact with the right-side surface of the movement member 11. In addition, the left-side restricting portion 16C projects upward from the bottom side frame 101D to a position that is higher than that of the third surface 11G of the movement member 11, so that it can swingably support the cam member 13A. The left-side restricting portion 16C comes in contact with the left-side surface of the movement member 11. This allows for the movement member 11 to be guided, in the movement direction A1, between the right-side restricting portion 16B and the left-side restricting portion 16C. It is noted that the upper surface of the movement member 11, except for the front-end portion thereof, is exposed on its upper side.

The separating member 12 shown in FIG. 6, in response to movement of the movement member 11, separates the driven-side shaft coupling 6 from the driving-side shaft coupling 9. Specifically, when the first surface 11E of the movement member 11 arrives at the specific position P43 (see FIG. 9B) as the movement member 11 is moving, the separating member 12 distances the driven-side shaft coupling 6 from the driving-side shaft coupling 9.

Specifically, the separating member 12 includes a base portion 12A and a pressing portion 12B.

The base portion 12A has a plate-like shape whose thickness along the front-rear axis Y is small. The base portion 12A is provided on a rear-end portion 11H of the movement member 11. Specifically, as shown in frame FL1 in FIG. 6, the base portion 12A extends rightward from the rear-end portion 11H to the rear side of the rear-end surface 10D. In addition, in the base portion 12A, the through hole 12C is provided at a position corresponding to the supporting shaft 10E. The supporting shaft 10E is inserted in the through hole 12C. During movement of the movement member 11, the base portion 12A is guided along the front-rear axis Y by the supporting shaft 10E. With this configuration, it is possible to prevent the base portion 12A from shifting along the left-right axis X and the up-down axis Z. and the base portion 12A can move along the front-rear axis Y.

As shown in frame FL1, the pressing portion 12B is provided on the rear-end portion 11H of the movement member 11, via the base portion 12A. Movement of the movement member 11 causes the pressing portion 12B to apply a force in the movement direction A1 to the driven-side shaft coupling 6, and when the first surface 11E arrives at the specific position P43 (see FIG. 9B), the pressing portion 12B separates the driven-side shaft coupling 6 from the driving-side shaft coupling 9.

Specifically, the pressing portion 12B has a plate-like shape whose thickness along the left-right axis X is small. The pressing portion 12B extends upward from the right side of the upper-end portion of the base portion 12A. In addition, as shown in FIG. 5, the pressing portion 12B extends to where the driven-side shaft coupling 6 is provided. Specifically, the pressing portion 12B extends to a position that is in front of the driving-side shaft coupling 9, and to the rear of the projecting portion 6B (that is, on the upstream side thereof in the movement direction A1) that is provided on the driven-side shaft coupling 6. The pressing portion 12B comes in contact with the projecting portion 6B from its rear in the shaft coupling engaged state (see FIG. 7, FIG. 9A).

During movement of the first surface 11E of the movement member 11 from the movement start position P41 (see FIG. 9A) to the specific position P43 (see FIG. 9B), the pressing portion 12B presses the projecting portion 6B in the movement direction A1, from the upstream side thereof in the movement direction A1. This allows for the pressing portion 12B to apply a force to the driven-side shaft coupling 6 in the movement direction A1, and separate the engagement portion 6A of the driven-side shaft coupling 6 from the engagement portion 9A of the driving-side shaft coupling 9. When the first surface 11E arrives at the specific position P43, the pressing portion 12B completely separates the engagement portion 6A from the engagement portion 9A. With this configuration, the link member 7 of the movement supporting mechanism 10 is made to be rotatable about the supporting shaft 10B.

More specifically, as shown in frame FL1 of FIG. 6, a guide portion 12D is provided on the upper portion of the pressing portion 12B of the separating member 12. Specifically, the guide portion 12D is a through hole in which the driven-side shaft coupling 6 is inserted (see FIG. 5). However, the guide portion 12D is not limited to this configuration, and may be a recessed portion in which a part of the driven-side shaft coupling 6 is fitted. As shown in FIG. 7, when the movement supporting mechanism 10 is attached to the image forming apparatus 100, the driven-side shaft coupling 6 is inserted in the guide portion 12D. It is noted that when the driven-side shaft coupling 6 is inserted in the guide portion 12D, the engagement portion 6A engages with the engagement portion 9A.

Figure 8:
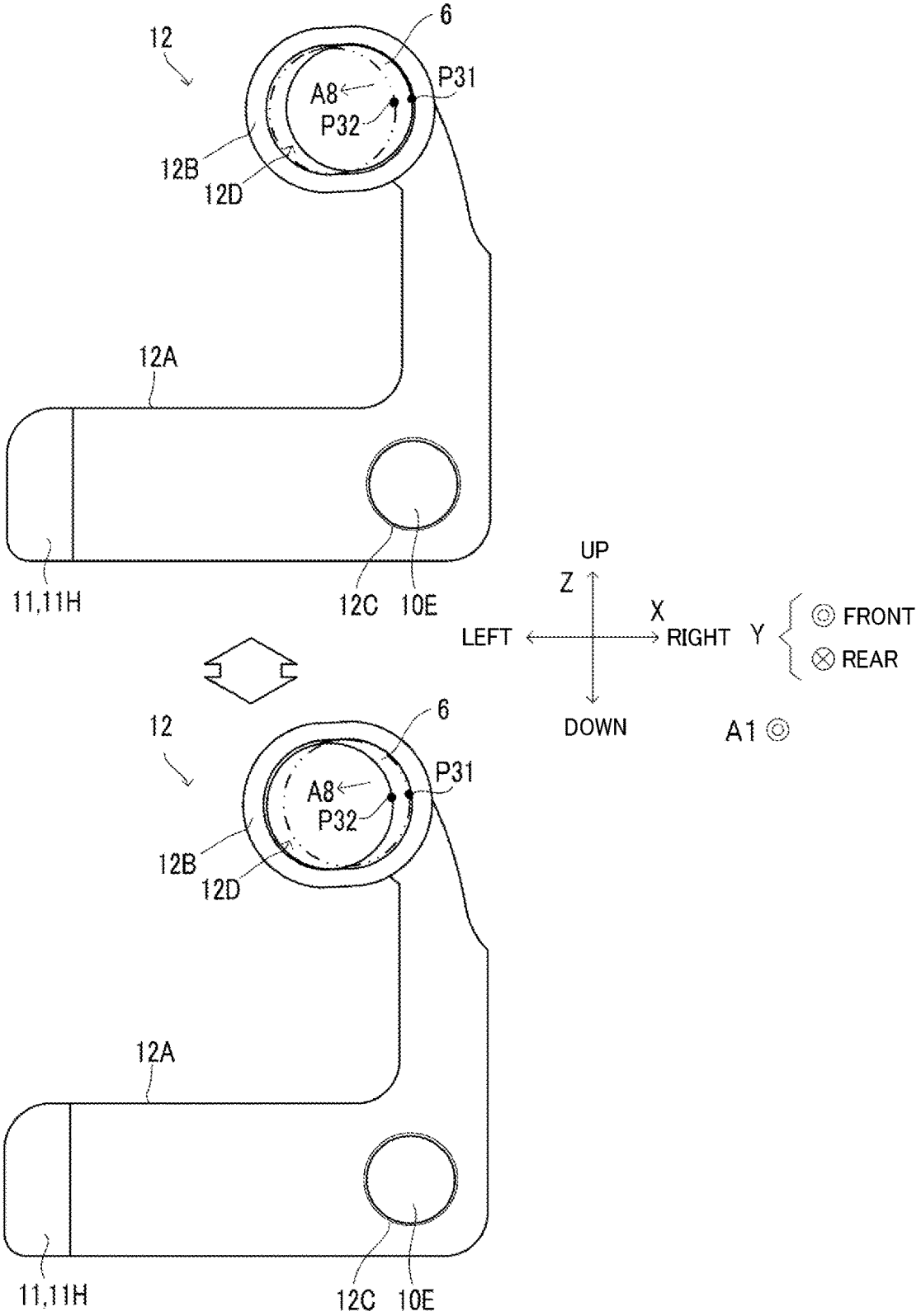
FIG. 8 is a diagram showing a separating member shown in FIG. 7 viewed from the front side, and indicates the position of the driven-side shaft coupling in relation to the separating member.

In addition, as shown in FIG. 8, the guide portion 12D has a shape such that it guides the driven-side shaft coupling 6 from the approaching position P31 to a separated position P32. The approaching position P31 is a position that corresponds to the developing position P11 (see FIG. 4), and is a position on the ZX plane where the driven-side shaft coupling 6 is positioned when the developing roller 5 is positioned at the developing position P11. The separated position P32 is a position that corresponds to the separated position P12 (see FIG. 4), and is a position on the ZX plane where the driven-side shaft coupling 6 is positioned when the developing roller 5 is positioned at the separated position P12. A separating direction A8 that extends from the approaching position P31 toward the separated position P32 is parallel to the separating direction A5 (see FIG. 4).

In addition, when the developing roller 5 moves from the developing position P11 to the separated position P12 (see FIG. 4), as shown in FIG. 8, the guide portion 12D becomes a path in which the driven-side shaft coupling 6 moves.

As shown in FIG. 4, during the separation of the driven-side shaft coupling 6 from the driving-side shaft coupling 9, that is, during the movement of the first surface 11E from the movement start position P41 to the specific position P43 (see FIG. 9B), the displacement members 13 apply power in the approaching direction A6 (see FIG. 4) to the movement supporting mechanism 10. With this configuration, the displacement members 13 restrict movement of the movement supporting mechanism 10, and position the developing roller 5 at the developing position P11 (see FIG. 4).

After the driven-side shaft coupling 6 has separated from the driving-side shaft coupling 9, and the movement member 11 moves further, that is, the first surface 11E moves further in the movement direction A1 from the specific position P43 (see FIG. 9C), the displacement members 13 apply a force in the separating direction A5 to the movement supporting mechanism 10. With this configuration, the displacement members 13 move the developing roller 5 from the developing position P11 to the separated position P12.

Specifically, the displacement members 13 cause the link member 7 of the movement supporting mechanism 10 to rotate about the supporting shaft 10B from the first angle position θ1 (see FIG. 4) to a second angle position θ2, and rotate the entire developing portion 110, including the developing roller 5, in a separating direction that separates away from the image-carrying member 2. The first angle position θ1 is predetermined in correspondence to the developing position P11. In addition, the second angle position θ2 is predetermined in correspondence to the separated position P12. Specifically, on the basis that the upward direction is 0° and the degree of the angle increases in the counter-clockwise direction when viewed from the front view, the supporting shaft 10B is at a larger angle when positioned at the second angle position θ2, than at the first angle position θ1.

Specifically, the displacement members 13 each include the cam member 13A. As shown in FIG. 6, the cam member 13A is provided in correspondence with the set of the first surface 11E, the second surface 11F, and the third surface 11G. During movement of the movement member 11, the cam member 13A moves relatively along the first surface 11E and the second surface 11F (see FIG. 9A to FIG. 9C), and is displaced along the intersecting axis A7.

As shown in FIG. 6, the cam members 13A have the same shape. Each cam member 13A includes a rotation shaft 13B and a lift portion 13C.

The rotation shaft 13B is provided at a position that is separated, in the forward direction by a predetermined distance, from the front-end portion of the first surface 11E. The rotation shaft 13B projects perpendicularly from the left-side restricting portion 16C in the rightward direction.

The lift portion 13C is supported, by the rotation shaft 13B, such that it rotates about the rotation shaft 13B along the ZX plane.

Figure 10:
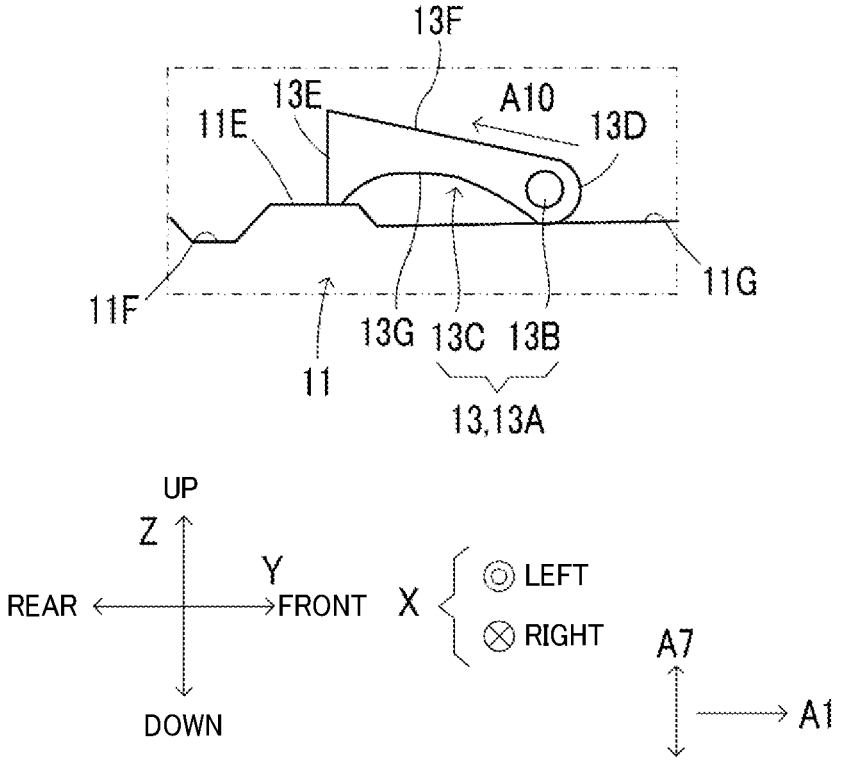
FIG. 10 is a diagram showing a detailed configuration of the cam member shown in FIG. 6 viewed from its left-side surface.

As shown in FIG. 10, the lift portion 13C includes a front-end surface 13D, a rear-end surface 13E, a flat surface 13F, and a bent surface 13G. The front-end surface 13D, the rear-end surface 13E, the flat surface 13F, and the bent surface 13G have the same width that is narrower than that of the movement member 11.

The front-end surface 13D is a surface on a downstream side of the lift portion 13C in the movement direction A1. The lift portion 13C is rotatably supported, about its corresponding rotation shaft 13B, at a portion thereof that is near the front-end surface 13D. The front-end surface 13D has an arc-like shape when viewed from a plane view with respect to the left-right axis X.

The rear-end surface 13E is a surface on an upstream side of the lift portion 13C in the movement direction A1. In addition, the rear-end surface 13E is separated, by a predetermined distance, from the front-end surface 13D in a centripetal direction A10 that extends, from the end portion on the downstream side of the lift portion 13C in the movement direction A1, toward the rotational center axis of the rotation shaft 13B.

The flat surface 13F is a surface that is parallel to the centripetal direction A10, and connects the upper ends of the front-end surface 13D and the rear-end surface 13E.

The bent surface 13G is a bent surface that defines the cam profile of the cam member 13A. Specifically, the bent surface 13G extends in the centripetal direction A10 from the bottom-end portion of the front-end surface 13D to the bottom-end portion of the rear-end surface 13E. Specifically, the bent surface 13G has a shape that, up to its center, slopes toward the flat surface 13F as it extends from its end portion on the front-end surface 13D side in the centripetal direction A10. In addition, the bent surface 13G has a shape that, from its center, slopes away from the flat surface 13F as it extends toward its end portion on the rear-end surface 13E side in the centripetal direction A10.

The rear-end portion of the first surface 11E moves from the movement start position P41 (see FIG. 9A) and arrives at the specific position P43 (see FIG. 9B). During this movement, the portion on the rear-end surface 13E side of each cam member 13A, that is, of each displacement member 13, comes in contact with the first surface 11E and the bottom portion 4A, and moves relatively along the first surface 11E in the opposite direction of the movement direction A1. During this movement, the lift portion 13C of the cam member 13A is not rotated about the rotation shaft 13B. With this configuration, the cam member 13A restricts the height of movement, along the up-down axis Z, of the bottom portion 4A such that it does not exceed the first specific height H1. The first specific height H1 is predetermined in correspondence to the developing position P11, the height H21, the approaching position P31, and the first angle position θ1. Specifically, when the height of the bottom portion 4A is the first specific height H1, the link member 7 is positioned at the first angle position θ1 (see FIG. 4), and the driven-side shaft coupling 6 is positioned at the approaching position P31 (see FIG. 8).

Specifically, while the cam member 13A is in contact with the housing 4, that is, during the movement of the rear-end portion of the first surface 11E to the specific position P43, the cam member 13A is in contact with the bottom portion 4A of the developing portion 110 and the first surface 11E, and applies a force in the approaching direction A6 to the link member 7 of the movement supporting mechanism 10. With this configuration, the cam member 13A restricts movement of the movement supporting mechanism 10 in the separating direction A5. On the other hand, since the developing roller 5 comes in contact with the development region R2, the developing roller 5 is positioned at the developing position P11, and the link member 7 is positioned at the first angle position θ1. In other words, by the movement of the rear-end portion of the first surface 11E from the movement start position P41 (see FIG. 9A) to the specific position P43 (see FIG. 9B), the developing roller 5 is positioned at the developing position P11, and the link member 7 is positioned at the first angle position θ1.

When the first surface 11E moves further in the movement direction A1 from the specific position P43 (see FIG. 9C), the portion on the rear-end surface 13E side of the bent surface 13G in each cam member 13A moves relatively from the position where it is in contact with the first surface 11E, to where it is in contact with the second surface 11F. The second surface 11F is provided at a position that has a lower height than that of the first surface 11E (see FIG. 9A). As a result, the lift portion 13C of the cam member 13A rotates about the rotation shaft 13B, is displaced along the intersecting axis A7 (more specifically, downward), and applies a force in the separating direction A5 to the link member 7 of the movement supporting mechanism 10. Specifically, the lift portion 13C comes in contact with a left-side end portion of the bottom portion 4A of the developing portion 110, and the supporting shaft 10B and the driven-side shaft coupling 6 are provided on the right-side end of the developing portion 110. Accordingly, when the lift portion 13C is displaced downward, the bottom portion 4A is displaced such that its height changes from the first specific height H1 to a second specific height H2. The second specific height H2 is predetermined in correspondence to the separated position P12, the height H22, the separated position P32, and the second angle position θ2.

Specifically, when the cam member 13A, that is, when the displacement member 13 moves along the intersecting axis A7 and moves relatively from the position where it is in contact with the first surface 11E, to where it is in contact with the second surface 11F, the link member 7 rotates about the supporting shaft 10B from the first angle position θ1 to the second angle position θ2 that corresponds to the separated position P32, thereby causing the developing roller 5 to move from the developing position P11 to the separated position P12. More specifically, when the bottom portion 4A of the developing portion 110 is displaced such that its height changes to the second specific height H2, a force in the separating direction A5 is applied to the link member 7. With this configuration, the link member 7 rotates in the separating direction A5, and moves from the first angle position θ1 to the second angle position θ2 (see FIG. 4). During this movement, the driven-side shaft coupling 6 is guided along the guide portion 12D, rotates in the separating direction A8 from the approaching position P31, and is displaced to the separated position P32 (see FIG. 8). Along with this movement, the developing roller 5 rotates in the separating direction A5 and is displaced from the developing position P11 to the separated position P12. In other words, the developing portion 110 is removed from the image forming apparatus 100 by the worker according to a predetermined procedure.

As explained above, in the image forming apparatus 100, by simply applying a force to the movement member 11 in the movement direction A1 and moving the movement member 11 by the specific distance FD1, it is possible for a worker to unlock engagement of the driven-side shaft coupling 6 and driving-side shaft coupling 9, and separate the developing roller 5 from the image-carrying member 2. That is, it is not necessary for the worker to perform the series of multiple steps. With this configuration, it is possible to simplify the series of multiple steps and improve the efficiency of the removal of the developing portion 110.

In addition, when the link member 7 rotates about the supporting shaft 10B from the first angle position θ1 to the second angle position θ2, the driven-side shaft coupling 6 is guided along the guide portion 12D that is provided on the pressing portion 12B. The pressing portion 12B does not only separate the driven-side shaft coupling 6 from the driving-side shaft coupling 9, but also moves the developing roller 5 from the developing position P11 to the separated position P12. That is, in the image forming apparatus 100, it is not necessary to individually include a configuration to separate the driven-side shaft coupling 6, and a configuration to support, when moving the developing roller 5, the end portion on the upstream side of the developing roller 5 in the movement direction A1. This allows for the configuration of the image forming apparatus 100 to be simplified.

In addition, by being displaced downward, the lift portion 13C of the cam member 13A applies a force to the link member 7 of the movement supporting mechanism 10 in the separating direction A5. In addition, during the displacement of the developing roller 5 from the developing position P11 to the separated position P12, the cam members 13A are in constant contact with the bottom portion 4A of the housing 4, and restricts rotation of the link member 7. In this way, according to the image forming apparatus 100, a simple configuration for displacing the developing roller 5 is achieved.

In addition, the operation portion 14 and the actuator 15 are provided in the image forming apparatus 100 to further simplify the series of multiple steps that are performed by the worker.

As shown in FIG. 2, the operation portion 14 is provided in correspondence with the process cartridge portions 108 and the developing portion 110. The operation portion 14 is rotatable about its rotational center axis that extends along a perpendicular axis A11 that is perpendicular to the movement direction A1, and can thereby open and close the opening 101B. Specifically, the perpendicular axis A11 is parallel to the left-right axis X.

Specifically, the operation portion 14 is a cover at the opening 101B that, by being operated by a worker, uncovers and covers front portions of its corresponding process cartridge portions 108 and developing portion 110. More specifically, the operation portion 14 is rotatably supported by a bracket 14B that is provided on the housing 101. Specifically, the bracket 14B includes two supporting portions 14C and 14D that are provided such that they are separated from one another, along the left-right axis X, by a predetermined distance. A shaft 14E that extends along the perpendicular axis A11 is provided across the space between the supporting portion 14C and the supporting portion 14D. A rotational member 14F is provided on a portion of the back surface 14A of the operation portion 14, at a position thereon that corresponds to the position of the shaft 14E. The rotational member 14F is provided with a through hole (not shown) in which the shaft 14E is inserted. With this configuration, when the worker operates the operation portion 14 according to a predetermined procedure, the rotational member 14F of the operation portion 14 rotates along the YZ plane about the rotational center axis of the shaft 14E, and thus the opening 101B can be opened and closed.

The actuator 15 uses the rotational force that is generated by the rotation of the operation portion 14 to move the movement member 11 in the movement direction A1.

Specifically, the actuator 15 is a rack and pinion. As shown in FIG. 9A to FIG. 9C, the actuator 15 includes an input gear 15A, an idle gear 15B, and an output gear 15C. The input gear 15A, idle gear 15B, and output gear 15C are each supported by the housing 101 such that it rotates about its center axis that extends along the left-right axis X. The input gear 15A includes teeth that are formed on the peripheral surface of the rotational member 14F. The idle gear 15B is a gear that meshes with the input gear 15A and the idle gear 15B. The output gear 15C meshes with the teeth of the idle gear 15B and the rack gear 15D. In the actuator 15, rotational force that is generated by rotation of the operation portion 14 is converted to a force in the movement direction A1 by the input gear 15A, the idle gear 15B, the output gear 15C, and the rack gear 15D, and the force is applied to the movement member 11. By appropriately designing the rack and pinion, it is possible to move the movement member 11 by the specific distance FD1 in the movement direction A1.

According to the operation portion 14 and the actuator 15, since the worker can complete the series of multiple steps by simply opening the operation portion 14, it is possible to further simplify the series of multiple steps.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

a developing portion including a developing roller that is configured to develop an electrostatic latent image formed on an image-carrying member, and a driven-side shaft coupling that is provided on the developing roller;

a driving-side shaft coupling configured to engage with the driven-side shaft coupling and transmit driving force, via the driven-side shaft coupling, to the developing roller;

a movement supporting mechanism configured to movably support the developing roller between a developing position and a separated position, wherein the developing position is where the developing roller develops the electrostatic latent image, and the separated position is further from the image-carrying member than the developing position;

a movement member configured to be movable in a predetermined movement direction;

a separating member configured to separate, in response to movement of the movement member, the driven-side shaft coupling from the driving-side shaft coupling; and a displacement member configured to, during separation of the driven-side shaft coupling from the driving-side shaft coupling, apply a force, to the movement supporting mechanism, in an approaching direction that extends from the separated position toward the developing position, and position the developing roller at the developing position, wherein when the movement member moves further in the movement direction after the driven-side shaft coupling has separated from the driving-side shaft coupling, the displacement member applies a force, to the movement supporting mechanism, in a separating direction that extends from the developing position toward the separated position, and moves the developing roller from the developing position to the separated position.

2. The image forming apparatus according to claim 1, wherein the separating member is provided on the movement member, and includes a pressing portion configured to, by movement of the movement member, apply a force to the driven-side shaft coupling in the movement direction, and separate the driven-side shaft coupling from the driving-side shaft coupling.

3. The image forming apparatus according to claim 2, further comprising a projecting portion projecting from the driven-side shaft coupling in a centrifugal direction that extends away from a rotational center axis of the driven-side shaft coupling, wherein the pressing portion, during movement of the movement member, presses the projecting portion from an upstream side in the movement direction, and applies a force, to the driven-side shaft coupling, in the movement direction.

4. The image forming apparatus according to claim 2, wherein the separating member is provided with a guide member that is a path along which the driven-side shaft coupling moves when the developing roller moves from the developing position to the separated position.

5. The image forming apparatus according to claim 1, wherein the movement member includes a first surface and a second surface that have different positions along an intersecting axis that is perpendicular to the movement direction, and are juxtaposed along the movement direction, and the displacement member includes a cam member that is configured to move relatively to the first surface and second surface, and be displaced along the intersecting axis, wherein the cam member, during movement of the first surface to a first specific position, comes in contact with the developing portion and the first surface, and applies a force to the movement supporting mechanism in the approaching direction, and when the first surface moves further from the first specific position in the movement direction, the cam member moves relatively from a position on the first surface to a position on the second surface, is displaced along the intersecting axis, and applies a force to the movement supporting mechanism in the separating direction.

6. The image forming apparatus according to claim 5, wherein the movement supporting mechanism includes a supporting shaft that is provided at a position that is separated from the developing roller and the displacement member, and includes a rotational center axis that is parallel to a rotational center axis of the developing roller, and a link member that extends from the developing portion to the supporting shaft, is provided with a through hole in which the supporting shaft is inserted, and is rotatable about the supporting shaft, wherein when the displacement member is in contact with the developing portion and the first surface, the link member is positioned at a first angle position that corresponds to the developing position, and when the displacement member moves relatively from the position on the first surface to the position on the second surface and is displaced along the intersecting axis, the link member rotates about the supporting shaft from the first angle position to a second angle position that corresponds to the separated position, and moves the developing roller from the developing position to the separated position.

7. The image forming apparatus according to claim 5, wherein the intersecting axis is an up-down axis, and the second surface is provided at a position that is lower than that of the first surface, and when the first surface moves further in the movement direction away from the first specific position, the cam member moves relatively from the position on the first surface to the position on the second surface, is displaced downward, and applies a force to the movement supporting mechanism in the separating direction.

8. The image forming apparatus according to claim 1, further comprising a housing provided with an opening that is further downstream in the movement direction than the developing portion, an operation portion configured to rotate about a rotational center axis that extends along a perpendicular axis that is perpendicular to the movement direction, and to open and close the opening, and an actuator portion configured to move, based on rotational force that is generated by rotation of the operation portion, the movement member in the movement direction.

* * * * *